US007842878B2

(12) United States Patent
Vorobyev

(10) Patent No.: US 7,842,878 B2
(45) Date of Patent: Nov. 30, 2010

(54) SYSTEM AND METHOD FOR PREDICTING MUSICAL KEYS FROM AN AUDIO SOURCE REPRESENTING A MUSICAL COMPOSITION

(75) Inventor: Yakov Vorobyev, Rockville, MD (US)

(73) Assignee: Mixed in Key, LLC, Rockville, MD (US)

( * ) Notice: Subject to any disclaimer, the term of this patent is extended or adjusted under 35 U.S.C. 154(b) by 286 days.

(21) Appl. No.: 12/127,511

(22) Filed: May 27, 2008

(65) Prior Publication Data

US 2008/0314231 A1 Dec. 25, 2008

Related U.S. Application Data

(60) Provisional application No. 60/945,311, filed on Jun. 20, 2007.

(51) Int. Cl.
*G10H 1/00* (2006.01)

(52) U.S. Cl. ..... 84/616; 84/609; 84/649; 84/654

(58) Field of Classification Search ..... None
See application file for complete search history.

(56) References Cited

U.S. PATENT DOCUMENTS

| | | | | |
|---|---|---|---|---|
| 7,612,280 | B2 * | 11/2009 | Schneider | 84/615 |
| 7,667,125 | B2 * | 2/2010 | Taub et al. | 84/616 |
| 2004/0054572 | A1 | 3/2004 | Oldale et al. | |
| 2005/0015258 | A1 | 1/2005 | Somani et al. | |
| 2007/0266843 | A1 * | 11/2007 | Schneider | 84/612 |

* cited by examiner

*Primary Examiner*—Marlon T Fletcher
(74) *Attorney, Agent, or Firm*—Oblon, Spivak, McClelland, Maier & Neustadt, L.L.P.

(57) ABSTRACT

A system and method thereof for determining the musical key of a musical composition. The system includes a database of reference musical works, defined by both a root musical key and a note strength profile, and a musical key estimation system that detects the musical key of the musical compositing based on relationships between the note strength profiles of the reference works and the note strength profile of the musical composition.

22 Claims, 10 Drawing Sheets

SYSTEM AND METHOD FOR PREDICTING MUSICAL KEYS FROM AN AUDIO SOURCE REPRESENTING A MUSICAL COMPOSITION

CROSS-REFERENCES TO RELATED APPLICATIONS

This application is a non-provisional application which claims benefit of co-pending U.S. Patent Application Ser. No. 60/945,311 filed Jun. 20, 2007, entitled "MUSICAL KEY DETECTION USING HUMAN TRAINING DATA" which is hereby incorporated by reference.

BACKGROUND OF THE INVENTION

The present invention relates generally to analyzing musical compositions represented in audio files/sources and more particularly to predicting and/or determining musical key information about the musical composition.

The capacity to accurately determine musical key information from a musical composition represented, for example, in a digital audio file has myriad applications. For instance, DJs and musicians often need accurate musical key information for audio sampling, remixing, or other DJ-related purposes. Specifically, musical key information can be used to create audio mash-ups, compose new songs, or overlay elements of one song with another song without experiencing a harmonic key clash. Although the need for musical key information is apparent, the method to obtain such information is not. Frequently, documentation concerning the musical composition is not available, e.g. sheet music, thereby frustrating any efforts directed toward discovering musical key information about the composition.

Even without the necessary documentation, musical key information about a composition can be determined by an artisan with a "trained" ear. Simply by listening to a musical composition, the artisan can proffer a reasonably accurate conclusion as to musical key information of the composition-in-question. Unfortunately, many are without such a skill set.

It is also known to use computer software to predict musical key information about a musical composition represented in an audio file. Representative software packages include Rapid Evolution available through Mixshare and MixMeister Studio marketed by MixMeister Technology, L.L.C. These software products allow an audio file or other source containing a musical composition to be analyzed for musical key information, although with varying degrees of success and utility.

Consider, for exemplary purposes, the following sequence illustrating one approach to extracting/predicting musical key information from a musical composition. Initially, the musical composition is decomposed into its constituent musical note components. The collection of constituent musical notes is then compared to a database of musical key templates—often twenty four templates, one for each musical key. Each template in the database describes the notes most commonly associated with a specific key. To predict musical key information, the software selects the template, i.e. musical key, with the highest correlation to the collection of constituent musical notes from the subject audio file. Moreover, the software may also provide correlation or probability information describing the relationship between the collection of constituent musical notes and each of the templates.

Unfortunately, the database of templates typically employed in these types of software applications is hampered by the style of compositions used to build the templates (styles or genres of music different from that used to generate the templates may distort the results) and the limited number of templates available, such as only twenty-four.

Thus, what is needed a musical key detection system that can readily accommodate different musical styles, have a database containing as many templates as desired, and provide additional metrics from which to more accurately predict musical key information from musical composition represented by digital audio signals.

BRIEF SUMMARY OF THE INVENTION

The present invention is a system and method for predicting and/or determining musical key information about a musical composition represented by an audio signal. The system includes a database having a collection of reference musical works. Each of the reference musical works is described by both a root key value and a note strength profile. The root key identifies the tonic triad, the chord, major or minor, which represents the final point of rest for a piece, or the focal point of a section. The note strength profile, or relative note strength profile, describes the frequency, duration and volume of every note in the reference musical work compared to other notes in the same musical work. Thus, for every reference musical work in the database, a corresponding root key and note strength profile exists. The root key and note strength profile may be determined through the same or different processes. For example, the root key may be determined by a neural network-based analysis of the reference musical work or by a skilled artisan with a trained ear listening to the song. The note strength profile may be determined by any number of software implemented algorithms. The database may include as many reference musical works are desired.

The present invention also provides a musical key estimation system coupled to the database, or, alternatively worded, capable of accessing the database. The musical key estimation system includes a note strength algorithm, an association algorithm, and a target audio file input. The note strength algorithm operates to determine the note strength of the target audio file (the audio file or audio source containing the musical composition of interest). To avoid confusion, it should be noted that the structure/content of the note strength of the target audio file (i.e. musical composition) and the note strength profile of the reference musical works are comparable. Further, in the preferred embodiment, the note strength algorithm can also be used to determine the note strength profiles of the reference musical works. The target audio file input is an interface, whether hardware or software, adapted to accept/receive the target audio file to permit the musical key estimation system to analyze the target audio file (i.e. musical composition).

The association algorithm predicts musical key information about the target audio file given the note strength of the target audio file and the information, i.e. reference musical works characteristics, in the database. Specifically, the association algorithm functions to predict musical key information based on an input, the note strength of the target audio file, and the existing relationships defined in the database by corresponding root keys and reference musical work note strength profiles and between different reference musical works. The association algorithm allows the musical key estimation system to generate implicit musical key information from the database given the note strength of the target audio file.

The association algorithm may be comprised of two main components, a data mining model and a prediction query. The data mining model is a combination of a machine learning algorithm and training data, e.g. the database of reference musical works. The data mining model is utilized to extract useful information and predict unknown values from a known data set (the database in the present instance). The major focus of a machine learning algorithm is to extract information from data automatically by computational and/or statistical methods. Examples of machine learning algorithms include Decision Trees, Logistic Regression, Linear Regression, Naïve Bayes, Association, Neural Networks, and Clustering algorithms/methods. The prediction query leverages the data mining model to predict the musical key information based on the note strength profile of the target audio file.

One important aspect of the present invention is the ability to have a database with reference musical works described by both a root key and a note strength profile. This provides the association algorithm with a database having multiple metrics describing a single reference musical work from which to base predictions. However, the importance lies not only in this multiple metric aspect but also in a database that can be populated with a limitless number of reference audio files from any styles or genres of music. In essence, the robust database provides a platform from which the association algorithm can base musical key information predictions. This engenders the present invention with a musical key prediction/detection accuracy not seen in the prior art.

DETAILED DESCRIPTION OF THE INVENTION

The present invention relates generally to analyzing musical compositions represented in audio files. More specifically, the present invention relates to predicting and/or determining musical key information about the musical composition based on the note strength of the composition in relation to a database of reference musical works, each reference musical work having a note strength profile and a root key value. A musical work or composition describes lyrics, music, and/or any type of audible sound.

Figure 1:
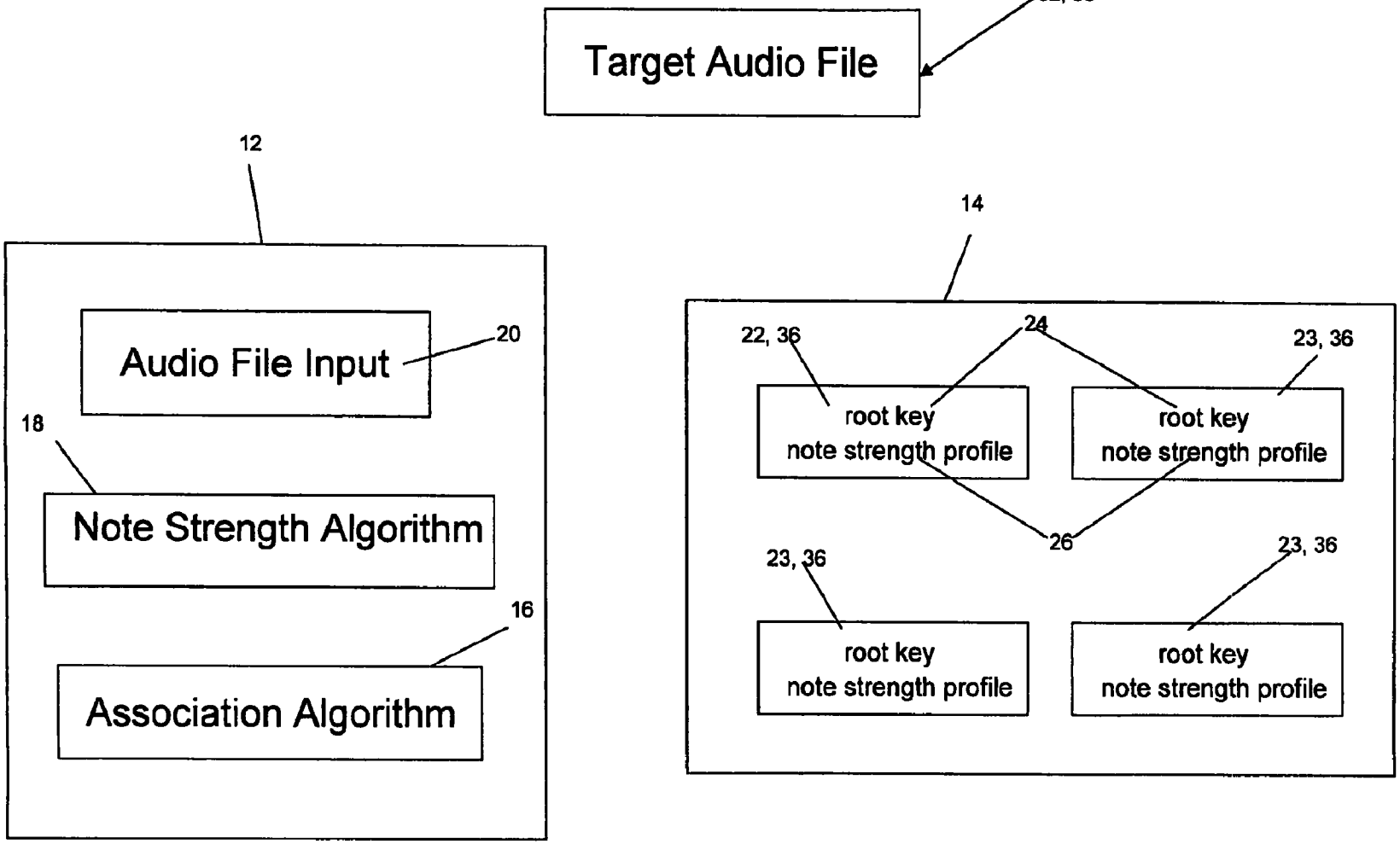
FIG. 1 is a block diagram of one embodiment of the present invention.

Now referring to FIG. 1, in one embodiment, the present invention 10 provides a musical key estimation system 12 coupled or having access to a database 14 or training database 14.

The musical estimation system 12 includes an association algorithm 16, a note strength algorithm 18, and an audio file input 20. The audio file input 20 permits the musical estimation system 12 to access or receive the target audio file 32, the target audio file 32 containing/representing the musical composition of interest 38 (the composition for which musical key information is desired, hereinafter "musical composition" 38). The target audio file 32 can be of any format, such as WAV, MP3, etc. (regardless of the particular medium storing/transferring the file 32, e.g. CD, DVD, hard drive, etc.). The audio file input 20 may be a piece of hardware; such as a USB port, a CD/DVD drive, an Ethernet card, etc., it may be implemented via software, or it may be a combination of both hardware and software components. Regardless of the particular implementation, the audio file input 20 permits the musical key estimation system 12 to accept/access the musical composition 38.

The note strength algorithm 18 is used to determine the note strength 34 of the musical composition 38 and, as will be explained in more detail below, provides a description of the musical composition 38 from which the predicted key information may be based. The note strength 34 provides a measure of the frequency, duration, and volume of every note in the musical composition 38 compared to other notes in the same composition 38 and operates as a signature for the musical composition 38. Accordingly, in the preferred embodiment, the note strength 34 is based on the relative core note values—a value for each musical note A, Ab, B, Bb, C, D, Db, E, Eb, F, F#, and G.

However, it is also within the scope of the present invention for the note strength 34 to encompass only a subset of the relative core notes and values, such as if the musical composition 38 does not contain one or more of the relative core notes or if processing/speed concerns dictate that not all of the relative core notes and values be used or, possibly, even needed. Further the present invention also envisages the note strength 34 composed of a set of notes greater than the relative core notes, for instance the note strength 34 may describe twenty-four or forty-eight notes. Even more generally, the note strength 34 may be composed of as many notes (e.g. frequency bands) as desired to effectively analyze the musical composition 38. For example, many modern pianos have a total of eighty-eight keys (thirty-six black and fifty-two white) and the note strength 34 may be composed of eighty-eight notes, one for each key on the piano. The set of notes comprising the note strength 34 is only constrained by the parameters of the association algorithm 16. Thus, if the association algorithm 16 accepts a note strength 34 with X number of elements then the musical composition 38 may be segmented into X number of elements by the note strength algorithm 18.

Figure 7:
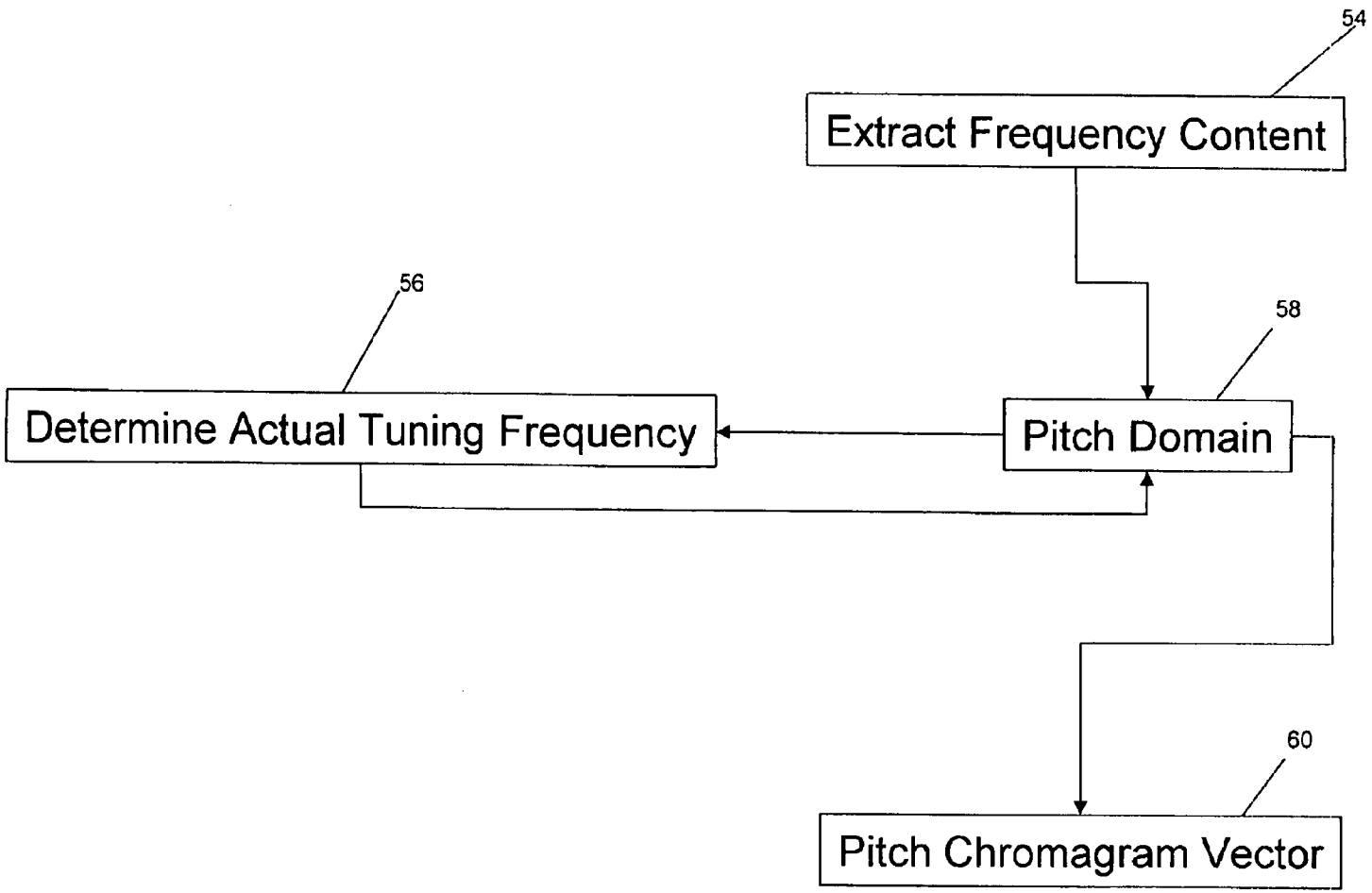
FIG. 7 is a flow chart illustrating the generation of a Pitch Chromagram Vector.

Referring to FIG. 7, although the note strength 34 can be determined in numerous ways, one implementation of the note strength algorithm 18 relies on extracting and examining the frequency content of the musical composition 38 (step 54). The audio signal of the musical composition 38 can be examined in (or converted to) the frequency domain by utilizing a Short Time Fourier Transform. Once the frequency spectrum is realized, the tonal content of the musical composition 38 can be extracted and/or identified in terms of both frequency position and magnitude. However, before the note strength 34 is finalized, it may be preferable to shift the scale of the note strength 34 according to the actual tuning frequency (or standard pitch) of the musical composition 38, rather than assuming the standard tuning frequency applies to the composition 38.

The tuning frequency of a musical piece is typically defined to be the pitch A4 or 440 Hertz. For the note strength 34 to provide a robust and meaningful description of the musical composition 38, the actual tuning frequency of the composition 38 should be accounted for (tuning frequencies may vary due to, for example, the use of historic instruments or timbre preferences, etc.). To this end, the note strength algorithm 18 extracts the tuning frequency in a pre-processing effort (step 56).

The pre-processing step may be accomplished, among others, by applying, in parallel, three banks of resonance filters, with their mid-frequencies spaced by one semi-tone (100 cent), to the audio signal. The mid-frequencies of the three banks are slightly shifted by a constant offset. The mean energy over all semi-tones is calculated, resulting in a three-dimensional energy vector, and the tuning frequency of the filter banks is adapted towards the maximum of the energy distribution. The final result of the tuning frequency of the "middle" filter bank is then the result of this pre-processing step. A similar process is also described by Alexander Lerch, *On the Requirement of Automatic Tuning Frequency Estimation*, Proc of 7$^{th}$ Int. Conference on Music Information Retrieval (ISMIR 2006), Victoria, Canada, Oct. 8-12, 2006, which is hereby incorporated by reference.

Figure 6:
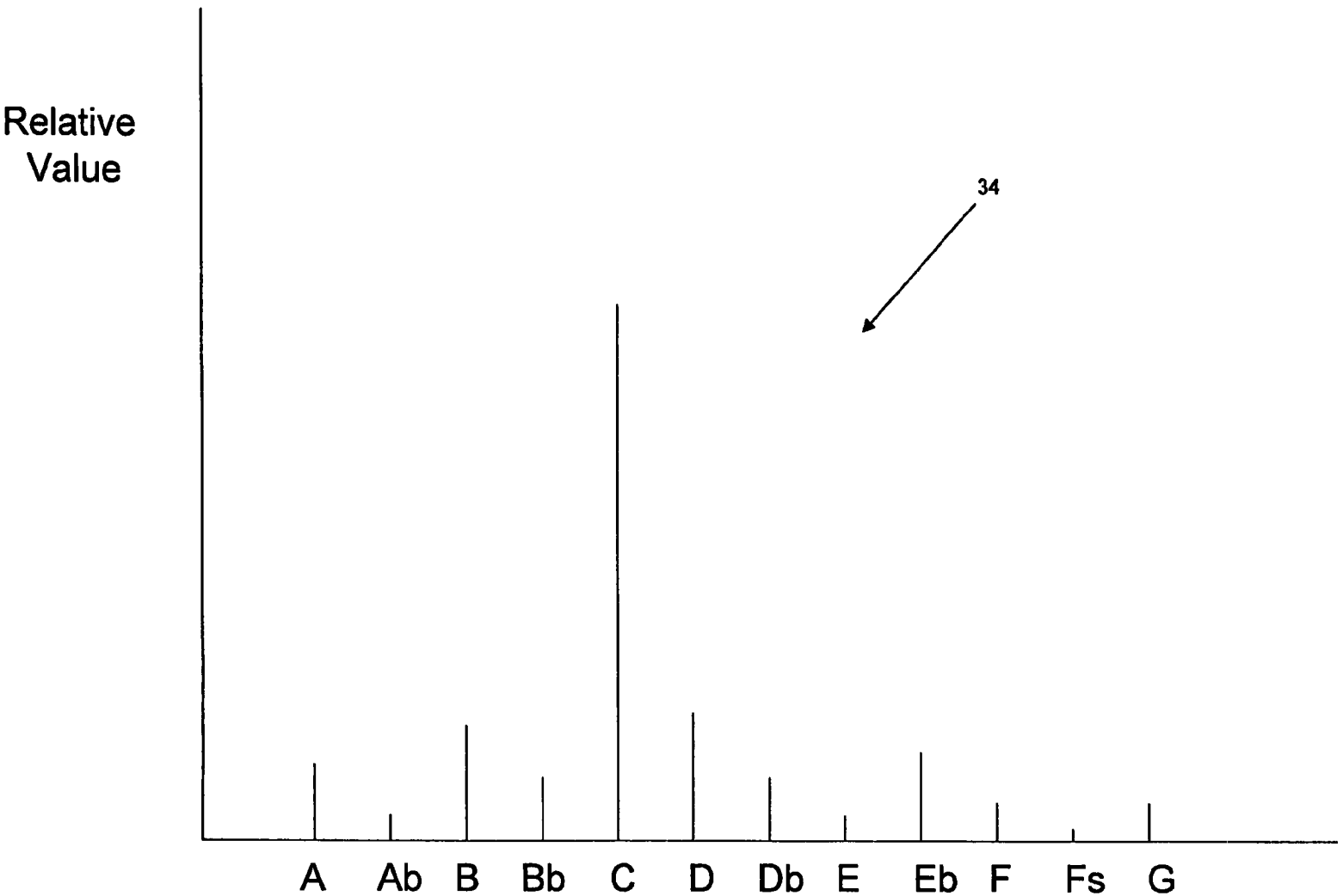
FIG. 6 is an exemplary visualization of one embodiment of a note strength for a musical composition.

Now that the actual tuning frequency is known, the tonal content, extracted from the frequency domain representation of the audio signal of the musical composition 38, can be converted into the pitch domain based on the actual tuning frequency of the musical composition 38—in essence, shifting the tonal content based on the actual tuning frequency, shown in step 58. The conversion results in a list of peaks with a pitch frequency and magnitude. This list is then converted into an octave-independent pitch class representation by summing all pitches that represent a C, C#, D, etc. from all octaves into one pitch chromagram vector that is 12-dimensional, one dimension for each pitch class, as shown in step 60. The pitch chromagram vector, visually represented in FIG. 6, is one embodiment of the note strength of the musical composition 34.

The database 14 includes a plurality of reference audio files 22 (also referred to as analyzed audio signals 22), each reference audio file 22 representing a musical work 36 (also refereed to as a musical piece 36 or reference composition 36) and having a root key 24 and a note strength profile 26 or reference note strength profile 26. The note strength profile 26 of a musical work 36 is analogous to the note strength of the musical composition 34 and, in the preferred embodiment, is obtained via the note strength algorithm 18 detailed above.

The root key 24 identifies the tonic triad, the chord, major or minor, which represents the final point of rest for a piece, or the focal point of a section. The root key 24 can be determined in numerous ways; such as by a neural engine after it has been trained by evaluating outcomes using pre-defined criteria and informing the engine as to which outcomes are correct based on the criteria, documentation accompanying the reference audio file 22 or musical work 36, the conclusion of an artisan with a trained ear, the musician or composer of the work 36, etc. Consequently, and importantly, all musical works 36 in the database 14 are described by two disparate metrics—root key 24 and note strength profile 26.

The database 14 may be contained on a single storage device or distributed among many storage devices. Further, the database 14 may simply describe a platform from which the plurality of reference files 22 can be located or accessed, e.g. a directory. The plurality of reference files 22 contained within the database 14 may be altered at any time as new reference musical works or supplemental analyzed audio files are added, removed, updated, or re-classified.

Figure 2:
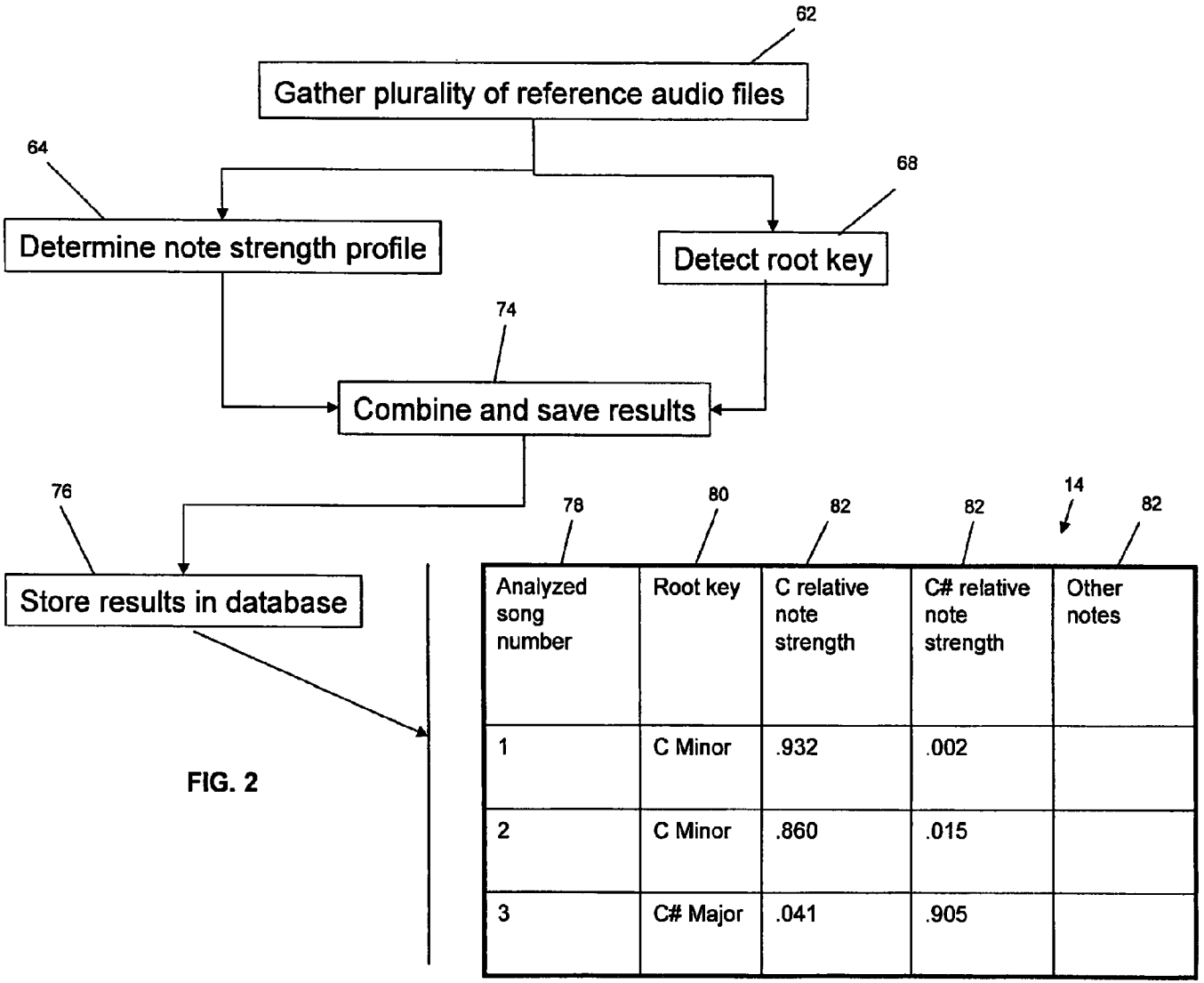
FIG. 2 is a schematic drawing of the training database used in the present invention.

The database 14 can be populated as depicted in FIG. 2. Initially, a plurality of reference audio files 22 are gathered (step 62). The files 22 are analyzed to detect the root key 24 and to determine the note strength profile 26 of each file 22 (steps 64 and 68, respectively). The corresponding root key and note strength profile information are merged (step 74), and stored in the database 14 (step 76). In one embodiment, the database 14 has an analyzed song number column 78 to differentiate between the plurality of reference audio files 22, a root key column 80 storing the root key 24 for each file 22, and individual note strength columns 82 containing the note strength profile for each of the plurality of reference audio files 22. The number of individual note strength columns 82 depends on the number of musical notes provided in the note strength profiles 26.

The association algorithm 16 predicts musical key information about the musical composition 38 by analyzing the note strength of the composition 34 in relation to both the root keys 24 and note strength profiles 26 of the plurality of reference audio files 22 (containing/representing the musical works 36). The association algorithm 16 of one embodiment is comprised of two main components: a data mining model 28 and a prediction query 30.

The data mining model 28 uses the pre-defined relationships between the root keys 24 and the note strengths profiles 26 and between different reference audio files 22 to generate/predict musical key information based on previously undefined relationships, i.e. a relationship between the note strength of the musical composition 38 and the reference audio files 22 or musical works 36. To realize this ability, the data mining model 28 relies on training data from the database 14, in the form of root keys 24 and note strength profiles 26, and a machine learning algorithm.

Machine learning is a subfield of artificial intelligence that is concerned with the design, analysis, implementation, and applications of algorithms that learn from experience, experience in the present invention is analogous to the database 14. Machine learning algorithms may, for example, be based on neural networks, decision trees, Bayesian networks, association rules, dimensionality reduction, etc. In the preferred embodiment, the machine learning algorithm (or association algorithm 16 more generally) is based on a Naïve Bayes model.

Bayesian theory is a mathematical theory that controls the process of logical inference. A form of Bayes' theorem is reproduced below:

$$P(A_i/B) = \frac{P(B/A_i) * P(A_i)}{\sum_j P(B/A_j) * P(A_j)}$$

Naïve Bayes models are well suited for basing predictions on data sets that are not fully developed. Specifically, Naïve Bayes models assume data sets are not interrelated in a particular way. This allows the above equation to be simplified as follows:

$$P(A/B) = \frac{P(B/A) * P(A)}{P(B)}$$

Where, in relation to the present invention, P(A/B) is the probability of a particular musical key given the note strength, P(B/A) is the probability of the note strength given a particular musical key, P(A) is the probability of a particular musical key, and P(B) is the probability of a particular note strength. Intuitively, P(B) would likely be zero, unless one of the plurality of reference audio files 22 (containing/representing the musical works 36) had exactly the same note strength/note strength profile as the musical composition 38—an unlikely scenario as the note strength is not restricted to a limited number of incarnations. Thus, the note strength profiles 26 are grouped into categories and it is the probability of these categories of note strength profiles that are used in the Naïve Bayes model for P(B).

The prediction query 30 utilizes the data mining model 28 to predict musical key information based on the note strength of the target audio file 34. However, this process need not be recreated for every different application; rather it can be facilitated by commercially available software. For illustrative purposes, a SQL database management package, distributed by Microsoft®, could be employed to build the data mining model 28 and request information from the database 14 via the data mining model 28. Advantageously, the SQL package has an integral Naïve Bayes-based data mining model/tool. One specific implementation of a Naïve Bayes-based data mining model/tool is presented in U.S. Pat. No. 7,051,037 issued to Thomas et al., and is hereby incorporated by reference.

Figure 3:
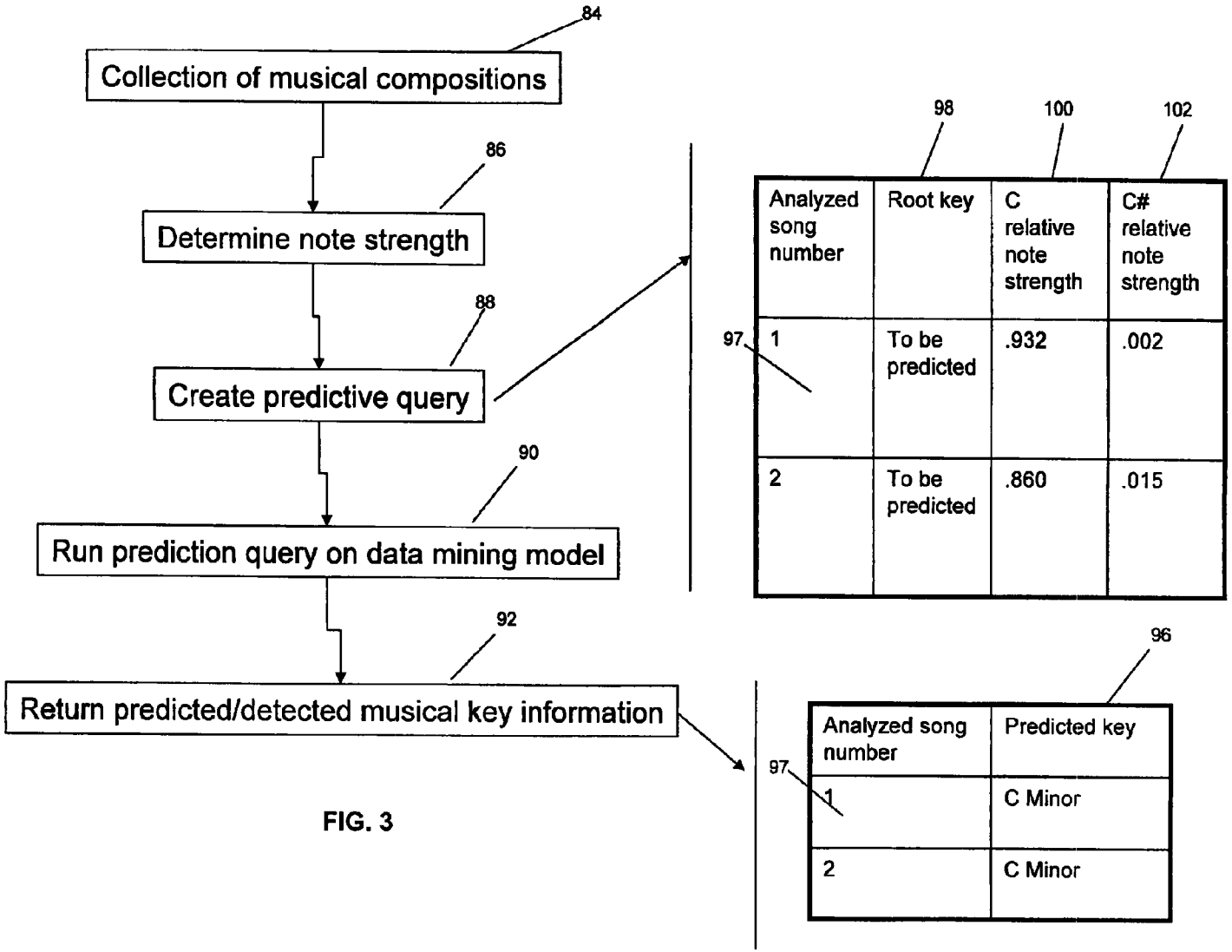
FIG. 3 is a flow diagram illustrating the sequence of steps used by the method of the present invention to predict musical key information.

FIG. 3 is a flow chart illustrating an exemplary sequence used by the present invention to detect/predict musical key information. One or more musical compositions 38 are collected (compositions from which detection of the musical key is desired) as shown in step 84. The musical compositions 38 are analyzed by the note strength algorithm 18 to generate note strengths 34 for each composition 38 (step 86). A prediction query 30 is generated directing the data mining model 28 to function (step 88). Columns 98, 100, and 102 represent typical query inputs. Step 90 illustrates the operation of the prediction query 30. In step 92, a predicted musical key is outputted, as represented by chart 96.

As is clear from FIG. 3, analyzed song 1 (97) has a note strength 34 with a C value of 0.932. With this value, as well as the other information in the note strength 34, the association algorithm determined, based on the root key 24 and note strength profiles of the musical works 26, that analyzed song 1 (97) has a predicted musical key of C Minor. The Naïve Bayes model P(A/B) indicates that given the note strength of analyzed song 1 (97) the probability that analyzed song 1 (97) is in the C Minor key, as opposed to all other keys, is greatest.

Figure 4:
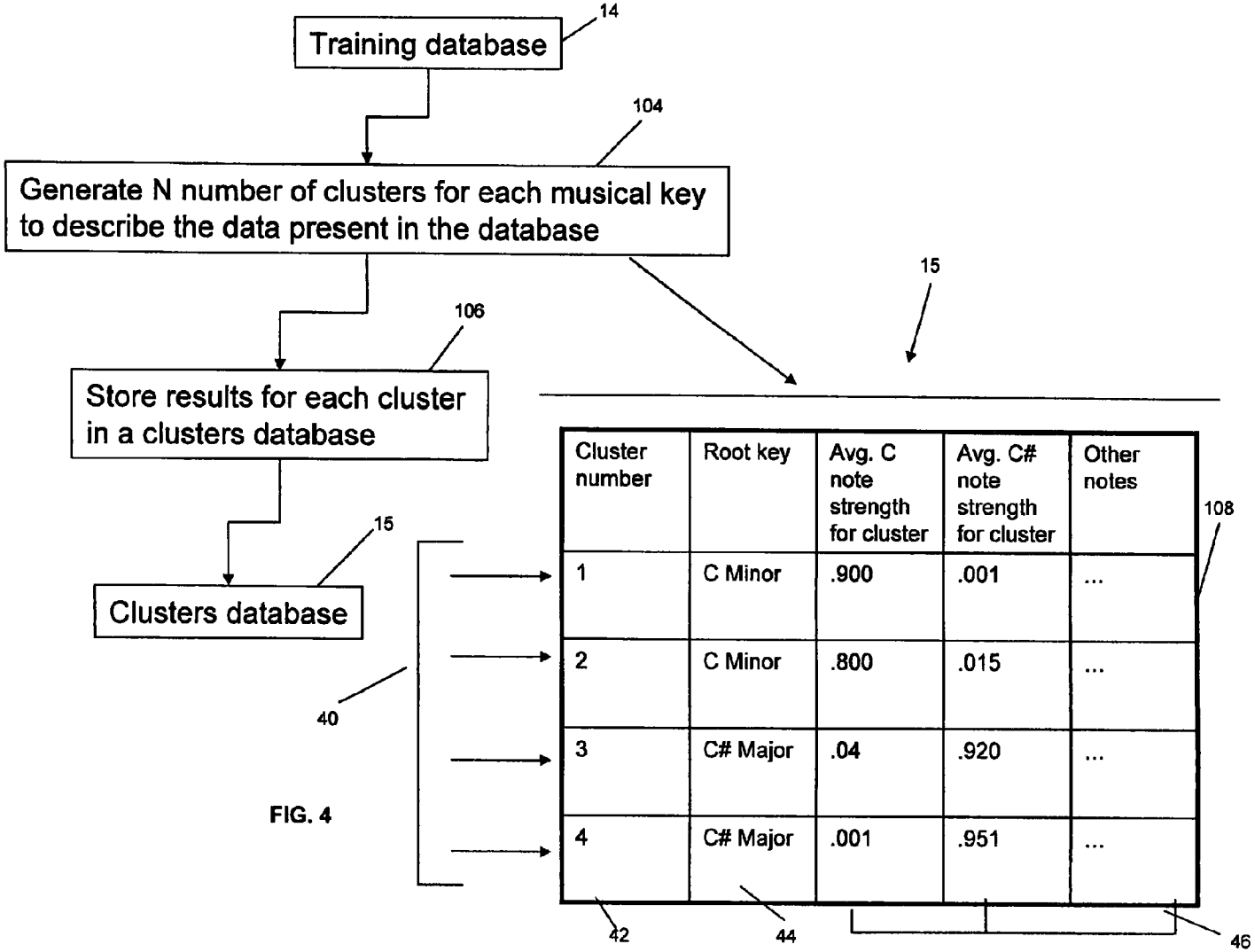
FIG. 4 is a schematic of another embodiment of the present invention detailing a Clusters database.

In another embodiment of the present invention, the association algorithm 16 can be based on data clustering ("Clusters") instead of a data mining model/tool. Clustering partitions a large data set, e.g. the database 14, into smaller subsets according to predetermined criteria. This process is detailed in FIGS. 4 and 5. Instead of relying on a data mining model 28, the database 14 is analyzed to generate clusters for every musical key in the database 14. Specifically, N clusters are generated to describe each different root key 24 present in the database 14, preferably with N>1, as seen in FIG. 4 step 104. Thus, multiple clusters may, and preferably will, describe the same musical key—however, with different note strength profiles 26. The reference audio files 22 will be placed in the clusters according to similarities in note strength profiles 26. This allows the present invention to compare/correlate the note strength of the musical composition 34 with multiple cluster templates for each musical key—to provide increased prediction accuracy. The results of the clusters classification/organization are then stored in a clusters database 15 as shown in step 106. The clusters database 15 may be a portion of the database 14 or a completely separate database.

An exemplary representation of a clusters database 15 having two C Minor clusters and two C Major clusters is depicted in FIG. 4 by chart 108. Preferably, each of the four clusters is composed of multiple reference audio files 22. Each cluster is stored as a separate database row 40 with the following columns: Generated Cluster Number 42, Root Key 44, and Average Note Strength Profile for Cluster 46 (average C note strength, average C# note strength, etc.)—having as many columns as required to account for necessary notes in the cluster The note strength profiles 26 may be obtained via the note strength algorithm 18.

Figure 5:
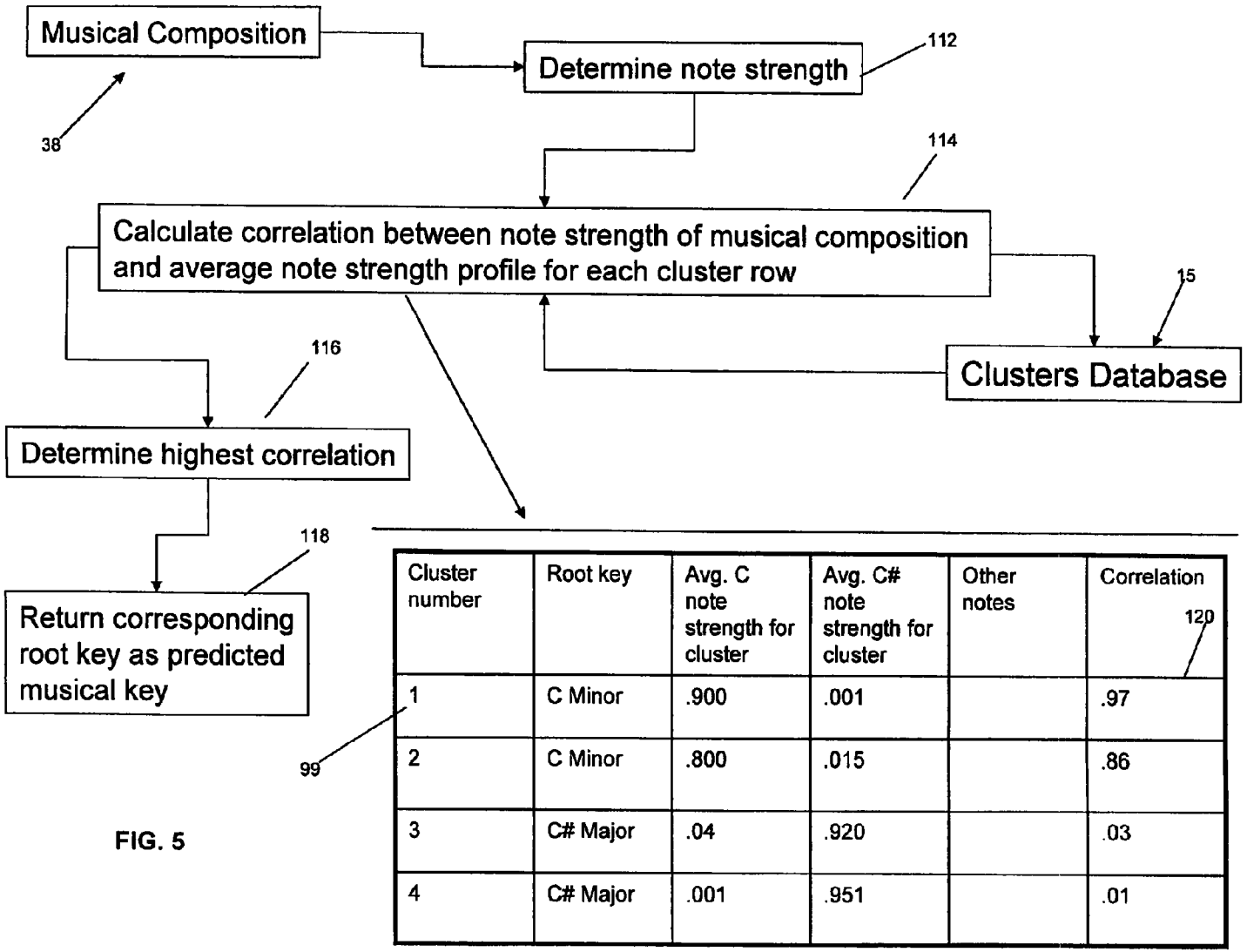
FIG. 5 is a flow diagram illustrating the sequence of steps used to predict musical key information based on the Clusters database.

A prediction sequence based on this Clusters embodiment is shown in FIG. 5. First, in step 112, a musical composition 38 is analyzed to determine its note strength 34, via the note strength algorithm 18. In step 114 the correlation between the note strength 34 and the average note strength profiles for every cluster row in the clusters database 15 is calculated—one correlation calculation for each cluster in the clusters database 15. The predicted musical key result is returned by querying the clusters database 15 for the cluster with the highest correlation between its average note strength profile and the note strength of the musical composition 34, as shown in step 116. Finally, in step 118, a musical key is predicted/detected, the predicted key being the root key 24 associated with the cluster having the highest correlation to the note strength of the musical composition 34. An example of the results returned via this process is shown by chart 120. Specifically, in this illustration the predicted musical key is C Minor according to the 0.97 correlation with the first C Minor cluster 99.

It should also be noted that the association algorithm 16 (whether via a Bayesian technique, Clusters technique, or other) can not only provide/predict the musical key with the highest probability or correlation to that of the musical composition 38 but also provide information about the probability or correlation for all other keys. In other words, the present invention can predict the likelihood of each possible key being the actual key of the musical composition 38.

Further, and once again independent of the particular technique employed, the operation of the musical key estimation system 12 can be described, in part, as generating a plurality of prospect values and using the prospect values to predict musical key information about the musical composition 38. Specifically, each distinct prospect value relates the note strength of the musical composition 34 to a distinct note strength profile of a musical work 26 (or group of musical works 26 as in the clusters method or the Naïve Bayes model). By evaluating the prospect values, the musical key estimation system 12 can select a candidate note strength profile (one particular note strength profile) from the plurality of note strength profiles 26 or grouped note strength profiles. The candidate note strength profile selected having a prospect value within an indicator range. The indicator range defining some metric, e.g. highest correlation between the note strength and note strength profile or lowest correlation. The musical key estimation system 12 then provides the root key 24 corresponding to the candidate note strength profile as the output or result.

Moreover, as the association algorithm 16 can employ techniques to predict/detect the musical key of the composition 38, the present invention also allows the results of the different techniques to be compared using a lift chart—a measure of the effectiveness of a predictive model calculated as the ration between the results obtained with and without the predictive model. Thus, when different association algorithms 16 (using different techniques) are more accurate that than others, the present invention can determine which techniques (or more precisely which association algorithm 16 using a specific technique) is more accurate and base the prediction of the most effective technique.

The database 14 may also include a composition classification system 48. The composition classification system 48 provides a structure that permits the plurality of reference audio files 22 to be organized (or at least searchable) according to the type of musical work they represent—such as jazz, classical, rock, etc. In some instances, better predictions may result if the association algorithm 16 only bases its efforts on musical works 36 in the same genre or style as the musical composition 38. Thus, if the musical composition 38 is known to be a jazz song (classified, for example, in a first class) then the present invention permits the association algorithm 16 to only employ musical works 36 in the database 14 classified as jazz works or in the first class, as determined by the composition classification system 48. However, and more generally, the composition classification system 48 allows the association algorithm 16 to use any number or type/style/genre of classifications for its predictions whether or not the classification of any particular musical work 36 accords with the style or genre of the musical composition 38.

Figure 8:
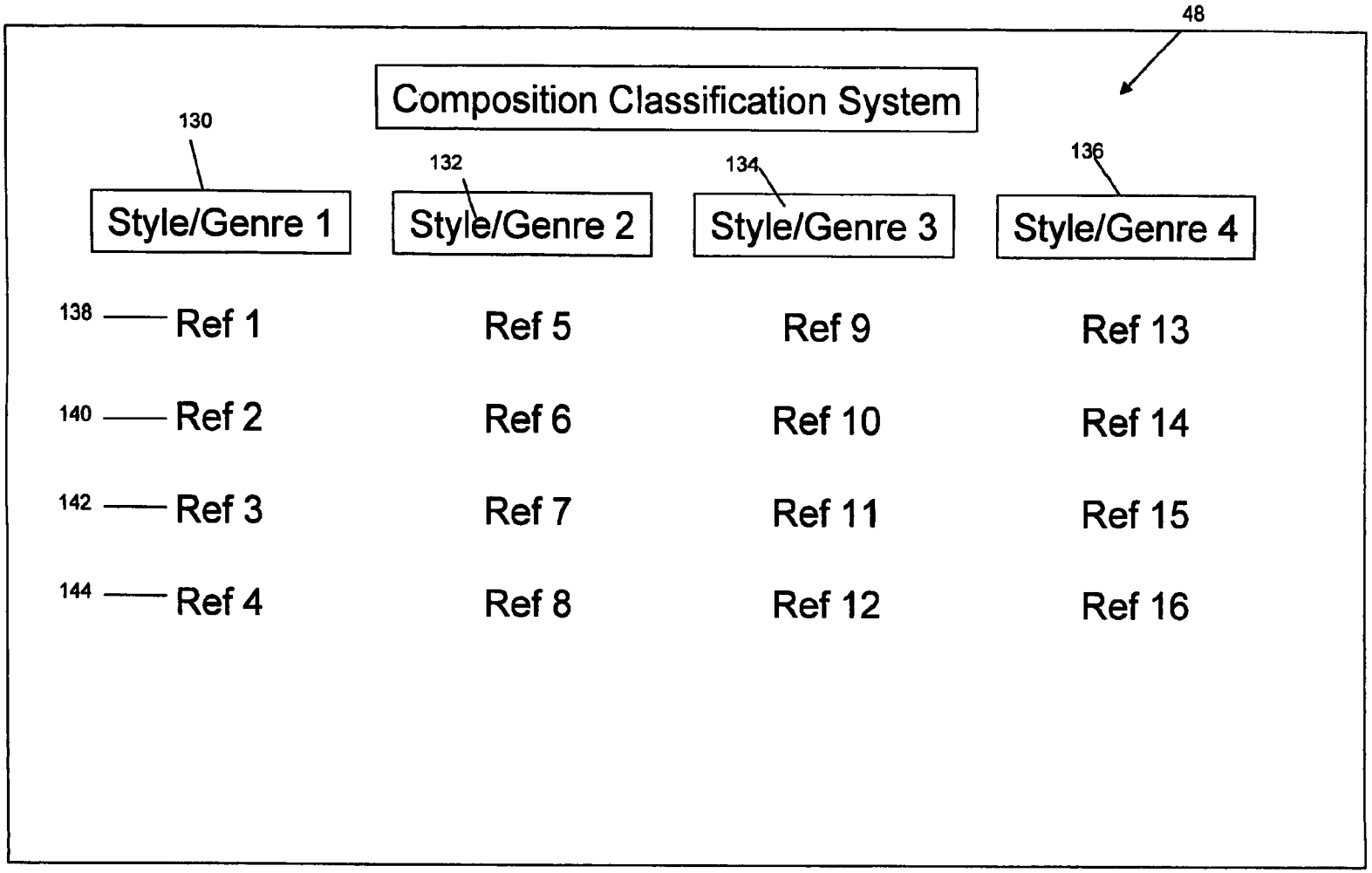
FIG. 8 is a schematic of one embodiment of a composition classification system.

FIG. 8 illustrates one exemplary composition classification system 48 having four different style/genre classifications 130, 132, 134, and 136. Each classification 130, 132, 134, and 136 classifies the plurality of reference audio files 22. Specifically, style/genre 1 (130) may classify Ref 1-Ref 4 (138, 140, 142, and 144). Style/Genre 1 (130) may be the class for pop music and, accordingly, Ref 1-Ref 4 (138, 140, 142, and 144) would represent pop musical works. Thus, when the association algorithm 16 operates, the musical composition 38 will be classified into on of the classes 130, 132, 134, and 136 and the association algorithm 16 will base its output on the reference audio files 22 classified in accord with the musical composition 38. In some applications, this process will enhance the effectiveness of the present invention.

Although in most cases an entire musical composition will be analyzed to detect the musical key, the present invention also permits the musical composition 38 to be analyzed in segments of varying size. Further, as the present invention can analyze the musical composition 38 in segments, it can also report key changes that occur during the composition 38. Thus, if the key of the musical composition 38 changes from A Minor to E Minor, the present invention can report the change and the specific segment in the composition 38 where the change occurred.

Figure 9:
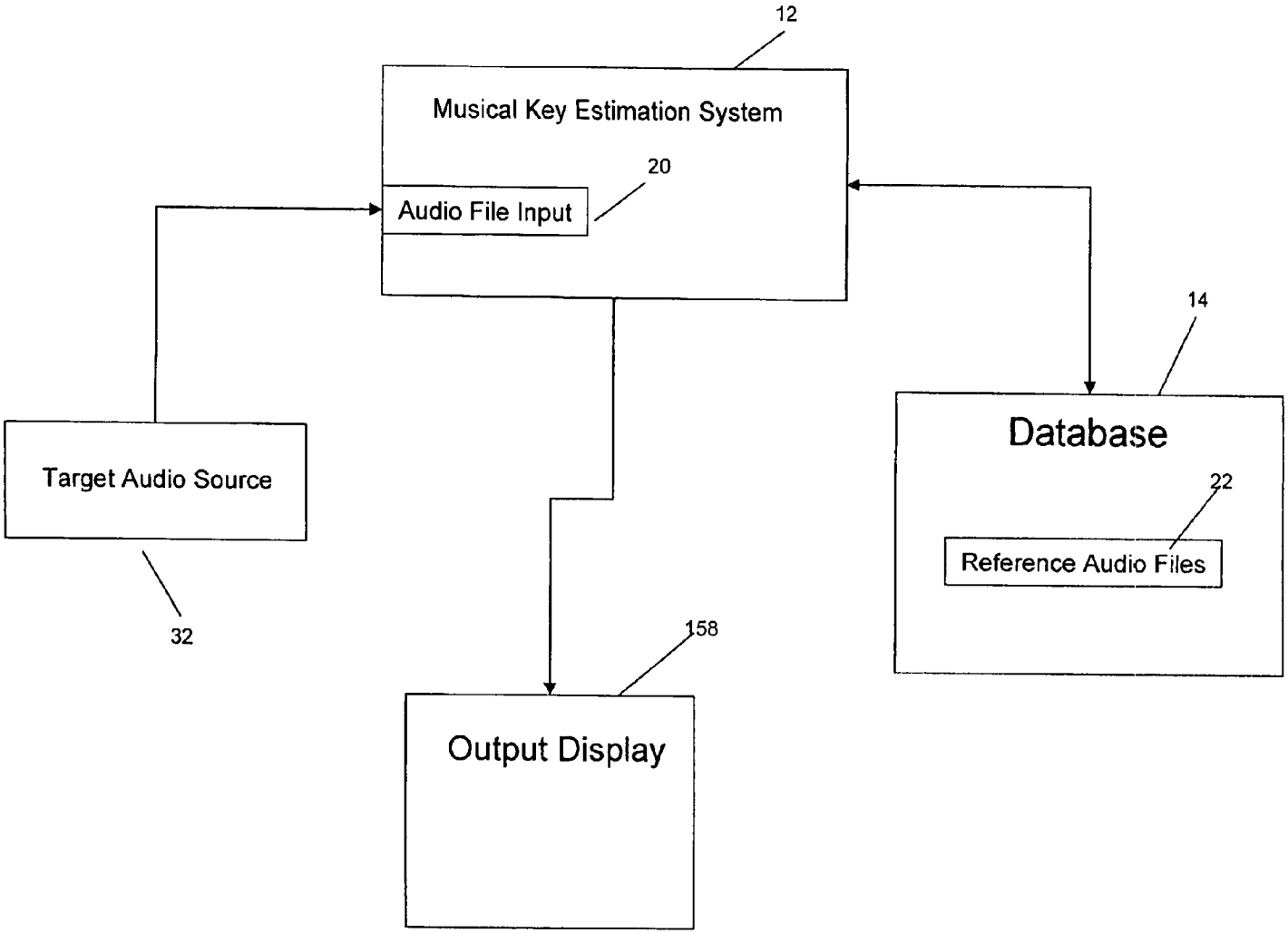
FIG. 9 is a schematic diagram of one implementation of the present invention.

FIG. 9 illustrates one exemplary implementation of the present invention. The target audio source 32 (representing the musical composition 38) may be embodied in or by a CD, DVD, flash drive, a streamed file, a floppy disk, a local hard drive (magnetically or optically based), a server, or the like. Additionally, and as discussed above, the target audio file 32 may be of any format, such as WAV, MP3, etc.

The audio file input 20 of the musical estimation system 12 is adapted to accept the target audio source 32. For example, if the target audio source 32 is a flash drive 32, the audio file input 20 may be a USB port 20 that receives the flash drive 32. Further, in this example, the musical key estimation system 12 may be a personal computer having a memory storage device, such as a first hard drive, that stores the association algorithm 16 and the note strength algorithm 18. The personal computer 12 may also provide the necessary control over the audio file input 20 (e.g. the USB port) to manipulate the target audio source 32 and provide the memory (e.g. the first hard drive, RAM, cache) and the processing power (e.g. the CPU) needed to execute the algorithms 16 and 18.

The database 14, containing the reference audio files 22, may be a separate storage device, e.g. another computer or a server, or it may be another component of the musical key estimation system 12, e.g. a second hard drive in the personal computer 12 or merely a part of the first hard drive. Irrespective of the configuration of the musical key estimation system 12 and the database 14, the association algorithm 16 is able to access and read the database 14 and the reference audio files 22 to generate/predict musical key information about the composition 38.

Figure 10:
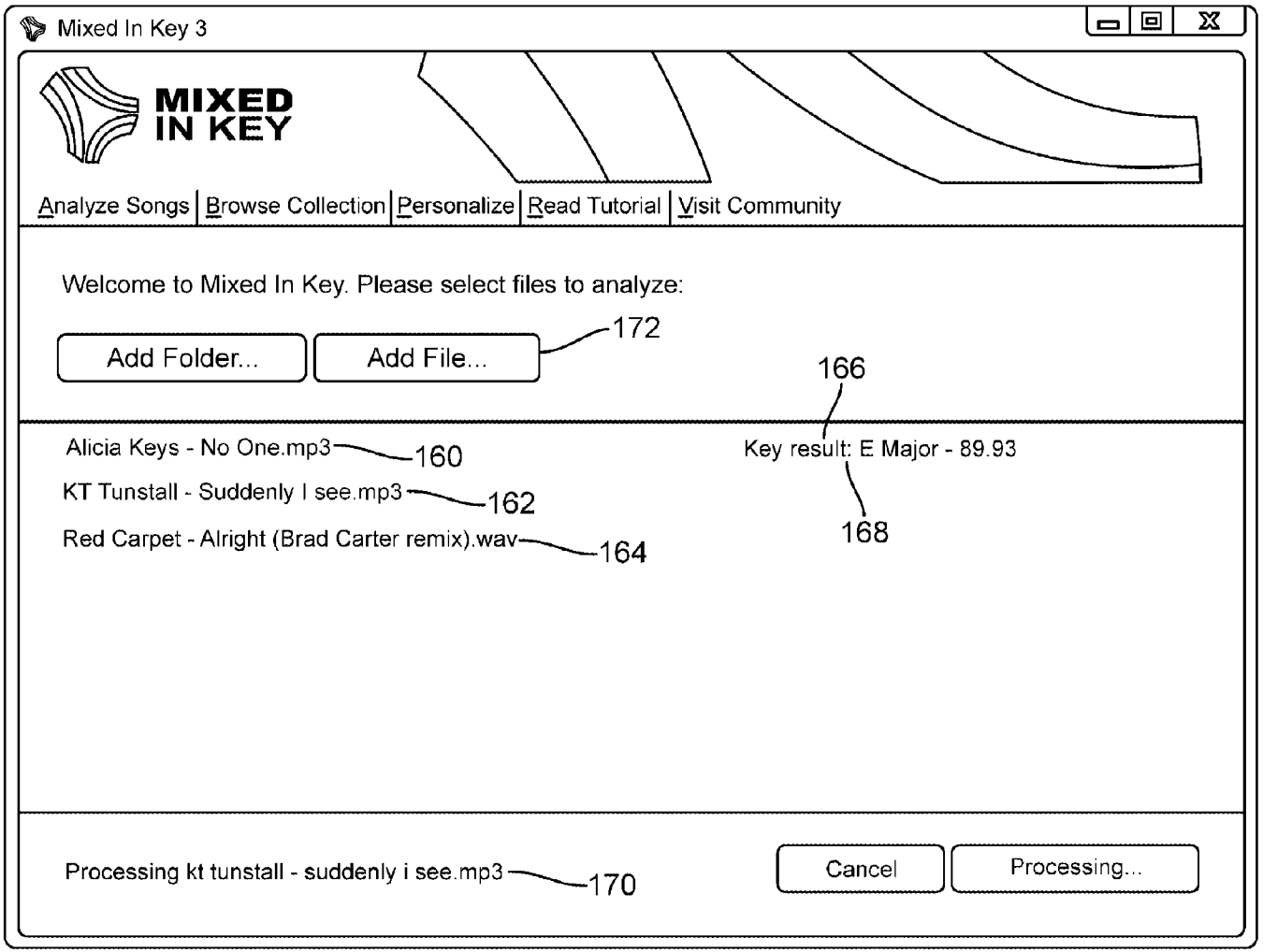
FIG. 10 is an exemplary screen shot of the output display of FIG. 9.

Once the association algorithm 16 has determined/predicted musical key information about the musical composition 38, the results may be reported on an output display 158, such as a computer monitor. FIG. 10 is an exemplary screen shot of musical key information being displayed on a computer monitor. Specifically, musical compositions 160, 162, and 164 have been selected for processing—to have their musical key information predicted. Additional musical compositions 38 can be added via button 172. FIG. 10 also shows predicted key information/results for compositions 160 and 162. Specifically, the predicted musical key for composition 160 is E Major 166 and for composition 162 is D Minor 168. As shown by status indicator 170, the present invention is in the process of analyzing composition 164.

Thus, although there have been described particular embodiments of the present invention of a new and useful SYSTEM AND METHOD FOR PREDICTING MUSICAL KEYS FROM AN AUDIO SOURCE REPRESENTING A MUSICAL COMPOSITION, it is not intended that such references be construed as limitations upon the scope of this invention except as set forth in the following claims.

What is claimed is:

1. A system for predicting a musical key of a musical composition represented by a target audio source, comprising:

a database including a plurality of reference audio files, each of the plurality of reference audio files represents a musical work and includes a root key and a note strength profile;

a musical key estimation system coupled to the database and having an association algorithm, a note strength algorithm, and an audio file input to accept the target audio file of said target audio source, wherein the note strength algorithm determines a note strength of the target audio file, the note strength being determined based on characteristics of notes as compared to other notes in the musical composition of the target audio file; and wherein the association algorithm predicts the musical key of the musical composition by analyzing the note strength in relation to the plurality of reference audio files in the database.

2. The system of claim 1, wherein the association algorithm includes one of a Naive Bayes model and a Clusters model.

3. The system of claim 1, wherein the characteristics include at least one of frequency, duration and volume.

4. The system of claim 1, wherein the association algorithm includes a neural network model.

5. The system of claim 1, wherein the note strength profiles are determined by the note strength algorithm.

6. The system of claim 1, wherein the database includes a composition classification system and the plurality of reference audio files are classified according to the composition classification system.

7. The system of claim 1, wherein the note strength of the target audio file comprises relative core note values.

8. The system of claim 1, wherein the note strength algorithm is operable to determine a standard pitch of the musical composition.

9. A method for predicting a musical key for a musical composition represented by an audio signal, comprising:

(a) providing the audio signal to a note strength algorithm to determine a note strength of the audio signal, the note strength being determined based on characteristics of notes as compared to other notes in the musical composition;

(b) providing the note strength to a computer-based musical key estimation system having an association algorithm and a training database comprising a plurality of reference audio files, each of the plurality of reference audio files represents a reference composition and includes a root key and a note strength profile;

(c) directing the association algorithm to generate an output based on both the note strength and the combination of the root keys and note strength profiles of the plurality of audio reference files in the training database; and (d) predicting the musical key of the musical composition according to the output of the association algorithm.

10. The method of claim 9, wherein the association algorithm includes at least one of a Naive Bayes model and a neural network model.

11. The method of claim 9, wherein the characteristics include at least one of frequency, duration and volume.

12. The method of claim 9, further comprising:

determining a tuning frequency of the musical composition.

13. The method of claim 12, further comprising:

altering the note strength according to the tuning frequency.

14. The method of claim 9, further comprising:

adding one or more supplemental audio files to the training database.

15. The method of claim 9, further comprising:

classifying the plurality of reference audio files according to a composition classification system.

16. The method of claim 15, further comprising:

classifying the musical composition in a first class according to the composition classification system, wherein at least one of the plurality of reference audio files is classified in the first class; and wherein in step (c) the association algorithm generates the output based on the at least one of the plurality of audio reference files classified in the first class.

17. A method for detecting a musical key for a musical composition represented by a target audio signal, comprising:

(a) analyzing the target audio signal, via a note strength algorithm, to determine a note strength of the target audio signal;

(b) providing the note strength to a musical key estimation system, wherein the musical key estimation system includes a training database having a plurality of analyzed signals, each of the plurality of analyzed signals represents a musical work and has a root key and a corresponding reference note strength profile;

(c) generating a plurality of prospect values by analyzing, via the musical key estimation system, the note strength in relation to the reference note strength profiles, wherein each of the plurality of the prospect values associates the note strength with one of the reference note strength profiles;

(d) selecting a candidate note strength profile from the reference note strength profiles based on prospect value, wherein the one of the plurality of prospect values associated with the candidate note strength profile is within an indicator range; and (e) predicting the musical key for the musical composition by determining the root key corresponding to the candidate note strength profile.

18. The method of claim 17, wherein the note strength comprises relative core note values.

19. The method of claim 17, further comprising:

classifying the plurality of analyzed signals according to a composition classification system.

20. The method of claim 17, further comprising:

determining a tuning frequency of the musical composition.

21. The method of claim 17, further comprising:

adding one or more supplemental analyzed audio signals to the training database, wherein each of the one or more supplemental analyzed audio signals represent a musical piece.

22. The method of claim 17, wherein the reference note strength profiles are determined by the note strength algorithm.

* * * * *